US008425353B2

(12) United States Patent
Jones et al.

(10) Patent No.: US 8,425,353 B2
(45) Date of Patent: Apr. 23, 2013

(54) CUSTOMIZABLE BAT

(75) Inventors: Steven Alan Jones, Portland, OR (US); Matthew A. Rhoades, Portland, OR (US); Damon M. Cellan, Portland, OR (US)

(73) Assignee: Nike, Inc., Beaverton, OR (US)

( * ) Notice: Subject to any disclaimer, the term of this patent is extended or adjusted under 35 U.S.C. 154(b) by 225 days.

(21) Appl. No.: 12/950,200

(22) Filed: Nov. 19, 2010

(65) Prior Publication Data

US 2012/0129634 A1 May 24, 2012

(51) Int. Cl.
*A63B 59/06* (2006.01)

(52) U.S. Cl.
USPC ..... 473/564; 473/568

(58) Field of Classification Search ..... 473/457, 473/519, 520, 564–568, 285, 300–303, 549–552
See application file for complete search history.

(56) References Cited

U.S. PATENT DOCUMENTS

| | | | | |
|---|---|---|---|---|
| 3,779,551 | A * | 12/1973 | Wilson | 473/568 |
| 4,131,981 | A * | 1/1979 | Scott et al. | 29/505 |
| 4,936,586 | A * | 6/1990 | Van Raemdonck | 473/519 |
| 5,499,737 | A * | 3/1996 | Kraus | 220/787 |
| 5,674,138 | A * | 10/1997 | Nolan | 473/457 |
| 6,443,860 | B1 * | 9/2002 | Byrne et al. | 473/568 |
| 7,232,387 | B1 * | 6/2007 | Heald et al. | 473/566 |
| 7,931,544 | B2 * | 4/2011 | Gill | 473/300 |
| 8,083,620 | B2 * | 12/2011 | Sims et al. | 473/568 |
| 2004/0038758 | A1 * | 2/2004 | Guenther | 473/457 |
| 2004/0110581 | A1 * | 6/2004 | Byrne et al. | 473/568 |
| 2006/0229147 | A1 * | 10/2006 | Nusbaum et al. | 473/457 |

* cited by examiner

*Primary Examiner* — Mark Graham
(74) *Attorney, Agent, or Firm* — Shook, Hardy & Bacon L.L.P.

(57) ABSTRACT

A customizable bat is described. The customizable bat may have a handle and a knob detachably affixed to an end of the handle by way of a knob-shaft inserted into a channel of the end of the handle. A pin may extend centrally from a top of the knob through the knob-shaft toward the handle. The pin may be shaped to engage with the knob of the customizable bat. The bat may also include a customizable marker that indicates information associated with the bat. The customizable marker may be removably integrated with the top of the knob and the pin of the bat. The customizable marker may be configured to securely fit around the pin of the bat.

16 Claims, 3 Drawing Sheets

CUSTOMIZABLE BAT

SUMMARY

The invention is defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

Large variations exist between the types and features of bats used in sporting activities such as baseball and softball. For example, the weight, length, barrel diameter or flexibility of a bat may affect a batter's swing, speed and/or ability to hit for power. Furthermore, some bats may be used primarily or only for training, such as weighted bats. The restrictions and requirements for bats may also vary between baseball leagues. A player's personal preferences typically also affect the specifications of the bat the player favors. Consequently, for an average baseball and/or softball team, a vast amount of bats with varying properties may be necessary. Conventional bats occasionally contain a label showing the bat's weight on the knob of the bat. However, the label is often a tiny mark on the knob of the bat that makes it time consuming for a player to efficiently find a desired bat. In addition, with extended use of the bat, the label on the bat knob often becomes worn and increasingly difficult to read. Conventional bats are also typically not readily customizable, rendering it difficult for individual players to spot their preferred bats. Further, teams or players may desire to identify their bat(s) with one or more color, insignia, or other identifier without having to mark on the bat(s) or affix tags or other items that must be removed prior to use. As such, there is a need for a readily customizable bat that provides an easy way to convey information pertaining to the specifications of the bat or the player/team associated with the bat.

The present invention provides a customizable bat. In accordance with the present invention, the customizable bat may have a barrel and a handle having an end distanced from the barrel of the bat. A first channel may extend within a center of the handle and the barrel. The customizable bat may also include a knob having a knob-shaft configured for insertion into the first channel of the end of the handle. The knob may include a second channel extending centrally from a top of the knob through the knob-shaft toward the handle. A pin may be detachably affixed in the second channel. The pin may detachably affix the knob to the end of the handle. The bat may also include a marker removably integrated with the top of the knob and the pin, the customizable marker may be configured to securely fit against the pin. The bat may be constructed using aluminum, composite or materials used in the manufacture of hollow constructed bats.

BRIEF DESCRIPTION OF THE SEVERAL VIEWS OF THE DRAWINGS

Examples of the present invention are described in detail below with reference to the attached drawing figures, which are incorporated by reference herein and wherein.

DETAILED DESCRIPTION

Figure 1:
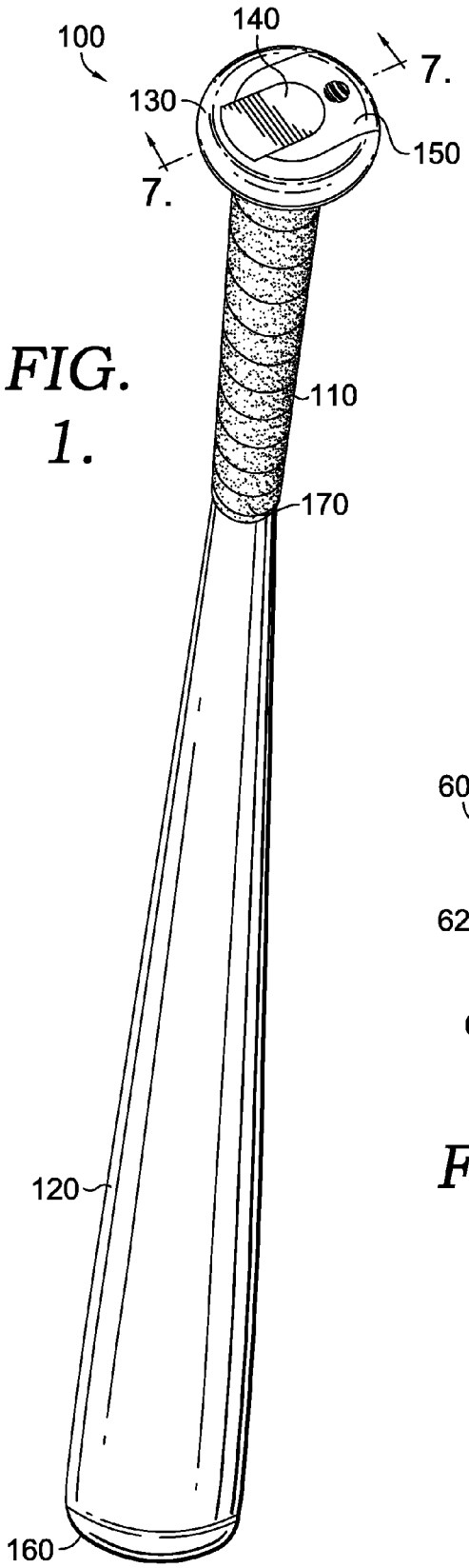
FIG. 1 depicts a perspective view of a baseball bat embodying features of the present invention.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

The present invention relates to a customizable bat. The customizable bat may have a handle and a knob detachably affixed to an end of the handle by way of a knob-shaft inserted into a channel of the end of the handle. A pin may extend centrally from a top of the knob through the knob-shaft toward the handle. The pin may be shaped to engage with the knob of the customizable bat. The bat may also include a customizable marker that may indicate information associated with the bat. The customizable marker may be removably integrated with the top of the knob and the pin of the bat. The customizable marker may be configured to securely fit against the pin of the bat.

Accordingly, in one aspect, the present invention provides a customizable bat. The customizable bat may have barrel and a handle having an end distanced from the barrel of the bat. A first channel may extend within a center of the handle and the barrel. The customizable bat may also include a knob having a knob-shaft configured for insertion into the first channel of the end of the handle. The knob may have a second channel extending centrally from a top of the knob through the knob-shaft toward the handle. A pin may be detachably affixed into the second channel to detachably affix the knob to the end of the handle. The bat may also include a marker that may indicate information associated with the bat. The customizable marker may be removably integrated with the top of the knob and the pin, the customizable marker may be configured to securely fit against the pin of the bat.

Customizable bats in accordance with the present invention may have a knob detachably affixed to one end of a handle via a pin engaging with the knob. The bats may include customizable markers that relay information associated with the bat. Having briefly described an overview of an embodiment of the present invention, an exemplary customizable bat is described below.

Referring to the drawings in general and FIGS. 1-7 in particular, an exemplary customizable bat is depicted in various views. While embodiments discussed herein refer to customizable baseball bats, it will be understood that embodiments are not limited to any particular style or type bat used during an athletic activity. For example, customizable bats in accordance with the present invention may be adapted for baseball, fast pitch softball, slow pitch softball, and/or any other sporting activity using a bat. Further, the depictions in the drawings are for exemplary purposes only and are in no way meant to limit the scope of the present invention to any style of bat.

Referring now to FIG. 1, a perspective view of a customizable bat illustrating features of the present invention is shown and designated generally as reference numeral 100. Customizable bat 100 may comprise a handle 110, a barrel 120, a knob 130, a pin 140, a marker 150, a tip 160 and a grip sleeve 170. Handle 110 and barrel 120 of bat 100 may be constructed of metal and/or composite materials. For example, handle 110 and/or barrel 120 may be manufactured using materials such as aluminum, graphite, fiberglass, ceramics and various resins. In some examples, the handle 110 and barrel 120 are comprised of different pieces materials fused together to form the bat. In other instances, handle 110 and barrel 120 are constructed from a single piece of material. Handle 110 may be covered by a grip sleeve 170. Grip sleeve 170 may be comprised of rubber materials or leather taped around handle 170 as illustrated in FIG. 1. While grip sleeve 170 may improve a batter's grip on the bat 100 and prevent the bat 100 from slipping out of the batter's hands during hard swings, customizable bats in accordance with the present invention need not necessarily provide a grip sleeve 170. Handle 110 may have an end proximate to barrel 120 with the other end of handle 110 near knob 130. Knob 130 may be detachably affixed to the end of handle 110 distanced from barrel 120. A pin 140 may be affixed to knob 130 by inserting pin 140 into a central opening at the top of knob 140. Pin 140 may be shaped to engage with both the knob 130 as well as a marker 150 that may be inserted in the knob 130. Bat 100 may include a tip 160 attached to the end of barrel 120 that is furthest from handle 110.

Marker 150 may be integrated with the top of knob 130 and pin 140. Marker 150 may be customizable, for instance, marker 150 may be customizable with respect to color and/or texture. In addition, marker 150 may be customized with various writings, emblems, designs and patterns. Marker 150 may be constructed of a plastic, metal or composite material or any other material that is readily customizable and used in the manufacture of baseball and/or softball bats. Marker 150 may be used to relay different types of information to a player or user of bat 100. By way of example, marker 150 may be used to indicate information about any physical property of the bat. For instance, marker 150 may contain information pertaining to the bat's weight, length, batting diameter, flexibility plus information about the materials used in manufacture of the bat. Furthermore, marker 150 may be used to indicate information pertaining to a player or team associated with a bat. By way of example, marker 150 may include the colors of a particular team in addition to the number of the player to whom bat 100 is assigned.

Figure 2:
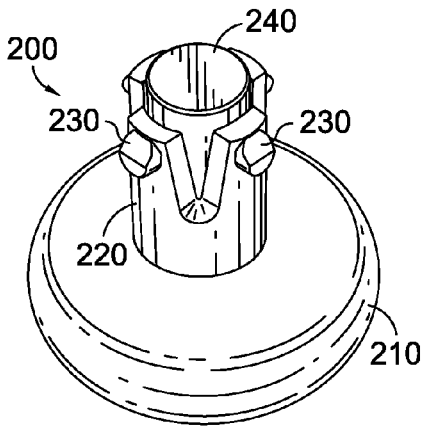
FIG. 2 depicts a perspective view of a knob of a customizable bat embodying features of the present invention.

Turning now to FIG. 2, a perspective view of a knob of a customizable bat illustrating features of the present invention is shown and designated generally as reference numeral 200. Knob 200 may comprise a knob head 210, a knob-shaft 220, and prongs 230. In a customizable bat in accordance with embodiments of the present invention, for instance bat 100 referenced in FIG. 1, knob 200 is located at the end of the bat handle. Knob 200 may prevent the bat from slipping through a player's hands when swinging. Knob 200 may also prevent materials from getting inside the handle and barrel of the bat. Head 210 comprises the portion of the knob 200 viewable when the knob 200 is installed at the end of the bat handle. As illustrated in FIG. 2, knob head 210 may have a rounded shape. However, other shapes commonly used in the manufacture of baseball/softball bats may also be used. A knob-shaft 220 may extend from the center of the base of knob head 210 towards the barrel end of an assembled bat, for instance bat 100 referenced in FIG. 1. The knob-shaft 220 comprises the portion of the knob 200 encased in the terminating end of the handle of an assembled customizable bat when the bat is assembled for use. Knob 200 may also comprise an opening in the center of knob-shaft 220. The opening may further extend through the center of the top of knob head 210. The opening may be configured to securely receive a pin 240 when the pin 240 is inserted in the knob 200. By way of example, the opening may be a cylindrical opening extending through the center of knob 200 such that a cylindrical portion of a pin 240 may be inserted through knob head 210 and knob-shaft 220. As illustrated in FIG. 2, knob-shaft may comprise a set of prongs 230 extending radially from the knob-shaft 220. The set of prongs 230 may engage portions of the handle of the bat to retain knob 200 therein. Upon complete insertion of pin 240 into the knob-shaft 220 of knob 200 a locking mechanism may be activated whereby prongs 230 are forced into hole radially distributed in the end of the handle of the bat.

Figure 3:
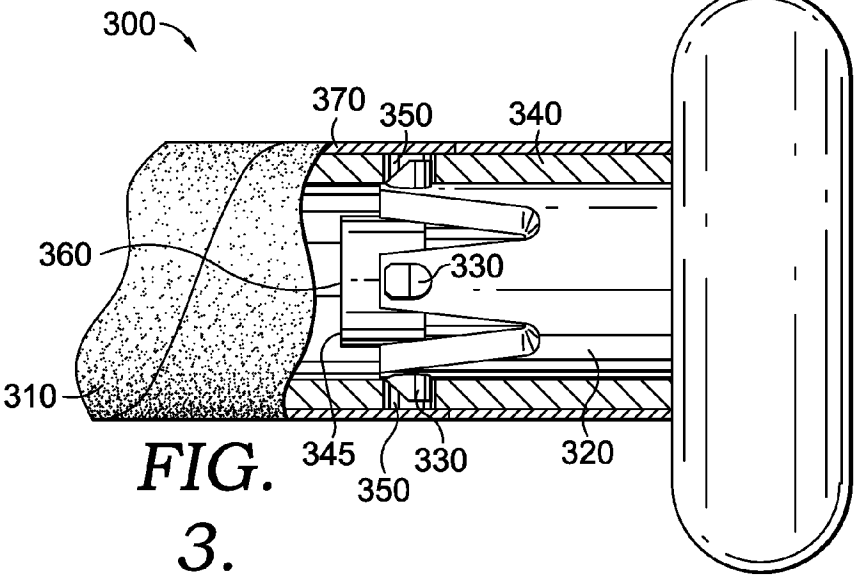
FIG. 3 depicts a partial cross-sectional side view of a knob engaged in a handle of a customizable bat embodying features of the present invention.

Turning now to FIG. 3, a partial cross-sectional side view of a knob engaged in a handle of a customizable bat illustrating features of the present invention is shown and designated generally as reference numeral 300. Customizable bat 300 may comprise knob 310, knob-shaft 320, prongs 330, handle 340, holes 350, pin 360 and gripping sleeve 370. Gripping sleeve 370 may be wrapped around the exterior of handle 340. The knob 310 of bat 300 may be detachably affixed to handle 340 when the knob-shaft 320 is inserted into a channel 345 within the handle 340. The handle 340 may comprise several internal holes 350 radially distributed around the end of handle 340 closest to knob 310. Internal holes 350 may be positioned such that upon insertion of knob-shaft 320 into channel 345 of handle 340, the prongs 330 of the knob-shaft 320 align and engage with holes 350. As illustrated in FIG. 3, the insertion of pin 360 into the knob-shaft 320 may push prongs 330 of the knob-shaft 320 into the internal holes 350 of the handle 340 thereby locking the prongs 330 of the knob 310 into the handle 340 of the bat. Conversely, removal of pin 360 from the center of knob 310 may cause the prongs 330 of the knob-shaft 320 to disengage with internal holes 350 of the handle 340 allowing knob 310 to be removed from bat 300.

FIG. 3 depicts the knob 310 of a customizable bat 300 in accordance with an embodiment of the invention detachably affixed to the handle 340 of bat 300 via prongs 330 of the knob 310 engaging with portions of the handle 340 of the bat. However, in alternative embodiments other locking mechanisms may be utilized to detachably affix a knob to the handle of a customizable bat. By way of example, knob-shaft 320 of knob 310 may include a series of grooves extending spirally around the knob-shaft 320 such that the knob 310 may detachably affixed to the end of handle 340 by screwing the knob-shaft 320 into the end of the handle of the bat.

Figure 4:
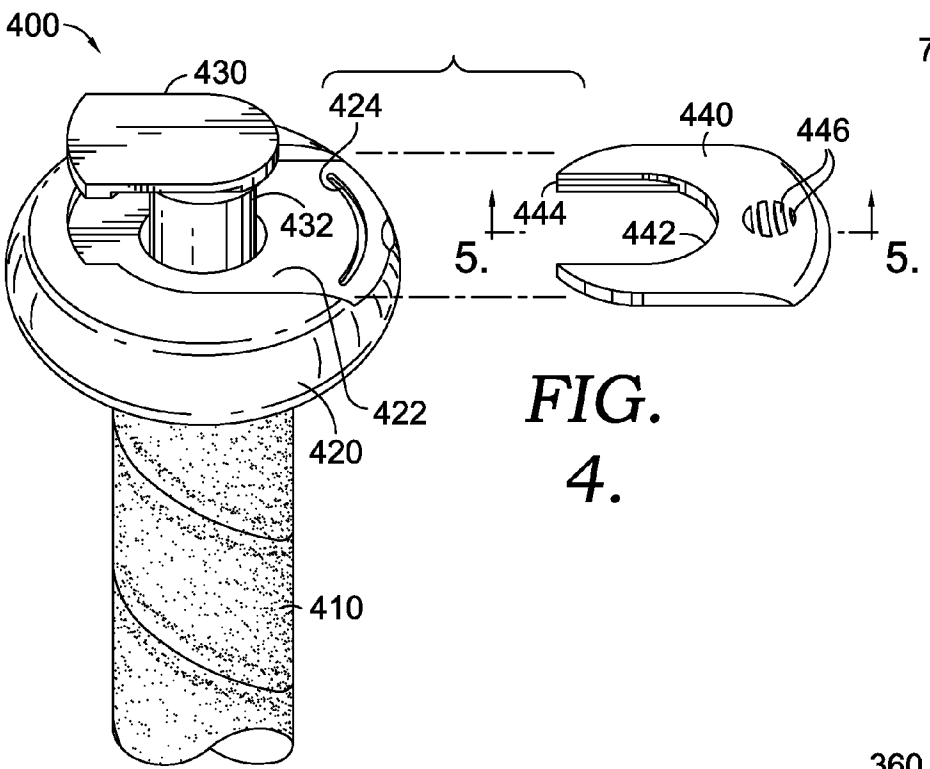
FIG. 4 depicts a perspective view of a portion of a customizable bat embodying features of the present invention.

Turning now to FIG. 4, a perspective view of a portion of a customizable bat illustrating features of the present invention is shown and designated generally as reference numeral 400. Customizable bat 400 may comprise a handle 410, a knob 420, a pin 430, and a marker 440. Knob 420 may be detachably affixed to handle 410 as previously described with reference to FIG. 3. Knob 420 may have a recessed area 422 configured to receive marker 440. Recessed area 422 of knob 420 may have external dimensions that correspond to the external dimensions of the marker 440. As such, recessed area 422 of knob 420 may facilitate marker 440 being removably secured in the knob 420. Recessed area 422 may also be configured with a shape to securely receive marker 440 such that marker 440 is substantially flush with the top of the knob upon its insertion into knob 420. The marker receiving recessed area 422 of knob 420 may also include a slot 424. Slot 424 may be configured to receive and engage a ridge of marker 440 upon its insertion into knob 420. While one slot 424 is depicted in FIG. 4, knob 420 may include multiple receiving slots 424 that couple with corresponding ridges on the base of marker 440.

Marker 440 of customizable bat 400 may be integrated between the top of knob 420 and the pin 430. Marker 440 may be constructed of a plastic material, and may be shaped such that the marker securely fits around the pin 430 when the marker is inserted into marker receiving recessed area 422. By way of example, the marker 440 may comprise a U-shaped inner face 442 that curves to fit securely around the pin 430. Of course, any other shape or geometry may be used for a marker in accordance with the present invention. The U-shaped inner face 442 of the marker 440 may comprise a pair of flanges 444 extending from either side of the inner face 442 of the marker 440. Each of the flanges 444 of marker 440 may align with and engage a corresponding undercut 432 located on pin 430. Customizable marker 440 may also comprise a set of friction ridges 446 that engage a player's finger to facilitate insertion and/or removal of the marker 440 into/from knob 420. The friction ridges 446 may include a series of ridges as depicted in FIG. 4, although other shapes and configurations of ridges on a marker that increase friction between a player's finger and the marker may be used.

Figure 5:
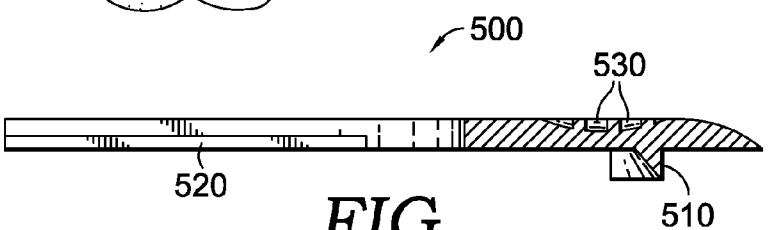
FIG. 5 depicts a cross-sectional view of a customizable marker embodying features of the present invention.

Turning now to FIG. 5, a cross-sectional view of a customizable marker illustrating features of the present invention is shown and designated generally as reference numeral 500. Marker 500 may comprise ridge 510, flange 520 and friction ridges 530. Ridge 510 may be located on the base of marker 500 such that the ridge 510 pops in a corresponding receiving slot located on the knob of the bat. For example, ridge 510 may be received by the receiving slot 424 depicted in the knob 420 of FIG. 4. Marker 500 may also include a flange 520 along the portion of the marker 500 that engages with the pin of the customizable bat. Flange 520 may slide and fasten into a corresponding undercut located on the pin. Marker 500 may also comprise a set of friction ridges 530 that engage a player's finger to facilitate insertion and/or removal of the marker 500 into/from the knob of the customizable bat.

Figure 6:
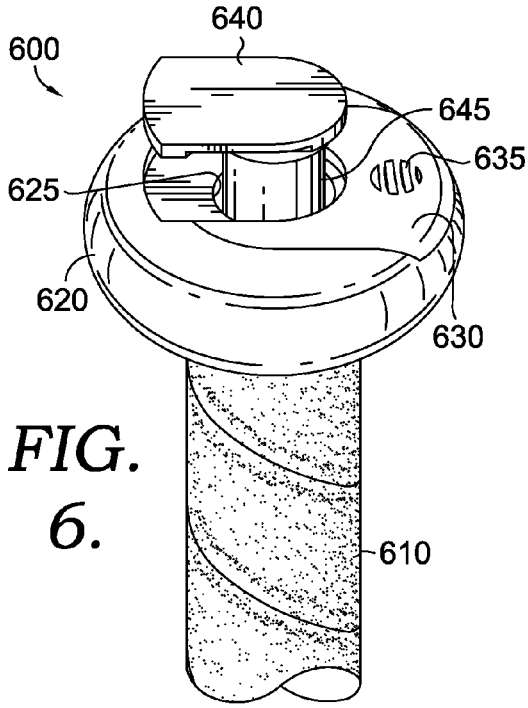
FIG. 6 depicts a perspective view of a portion of a customizable bat embodying features of the present invention.

Turning now to FIG. 6, a perspective view of a portion of a customizable bat illustrating features of the present invention is shown and designated generally as reference numeral 600. Customizable bat 660 may comprise a handle 610, a knob 620, a customizable marker 630 and a pin 640. Knob 620 may be detachably affixed to the end of handle 610 as previously described with reference to FIG. 3. A pin 640 may be detachably affixed to knob 620 by inserting pin 640 into a central opening 625 at the top of knob 620. As illustrated in FIG. 6, pin 640 may be shaped to engage with both the knob 620 as well as customizable marker 630 that may be inserted in the knob 620. A shaft portion 645 of pin 640 may be inserted into the opening 625 at the top of the knob, such that the shaft portion 645 of the pin 640 extends down through the knob-shaft of knob 620. Pin 640 may be constructed of a metal or a plastic material. Marker 630 of customizable bat 600 may be integrated between the top of knob 620 and the pin 640 and may be shaped such that the marker 630 securely fits around the pin 640. Marker 630, knob 620 and pin 640 may be configured such that marker 630 is substantially flush with the top of knob 620 upon insertion of the marker 630 into the knob 620. Marker 630 may also have a set of friction ridges 635 that engage a player's finger to facilitate insertion and/or removal of the marker 630 into/from the knob 620 of the customizable bat 600.

Figure 7:
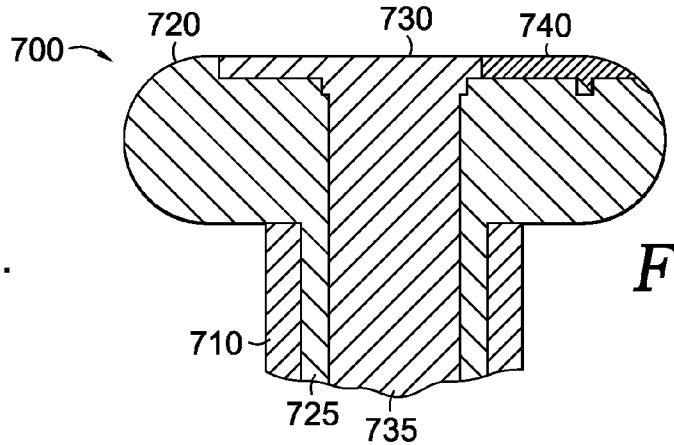
FIG. 7 depicts a cross sectional view of a portion of a customizable bat embodying features of the present invention

Turning now to FIG. 7, a cross sectional view of a portion of a customizable bat illustrating features of the present invention is shown and designated generally as reference numeral 700. Customizable bat 700 may include a handle 710, a knob 720, a pin 730 and a customizable marker 740. Knob 720 may be detachably affixed to handle 710 by inserting a knob-shaft 725 into handle 710. In addition a shaft portion 735 of pin 730 may securely fasten in a central opening extending through the knob-shaft 725. Customizable marker 740 may be integrated in the top of knob 720 such that the top of marker 740 is substantially flush with the top of the knob 720 upon insertion of the marker 740 into the knob 720.

Figure 8:
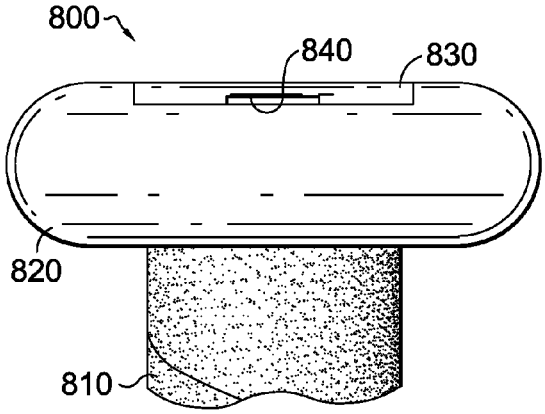
FIG. 8 depicts a perspective view of a portion of a customizable bat embodying features of the present invention.

Turning now to FIG. 8, a perspective view of a portion of a customizable bat illustrating features of the present invention is shown and designated generally as reference numeral 800. Customizable bat 800 may comprise a handle 810, a knob 820, and a marker 830. Knob 820 may be detachably affixed to handle 810 as previously described with reference to FIG. 3. Marker 830 may comprise a groove 840 that permits a player to use a fingernail or thin object to pry up the marker 830 to allow removal of marker 830 without removing the knob 820 and/or pin. Marker 830 may be constructed of plastic or other material sufficiently flexible to permit the removal of marker 830 from knob 820 by prying the marker up from the knob.

Figure 9:
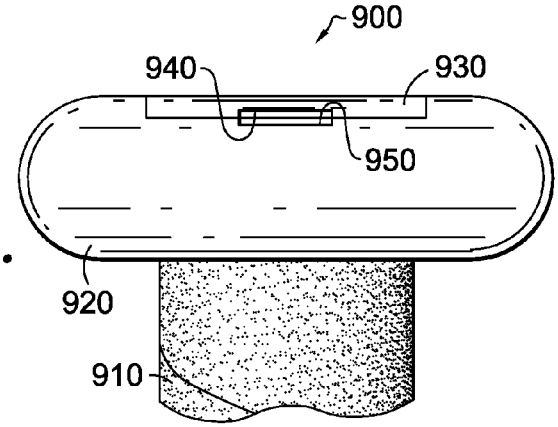
FIG. 9 depicts a perspective view of a portion of a customizable bat embodying features of the present invention.

Turning now to FIG. 9, a perspective view of a portion of a customizable bat illustrating features of the present invention is shown and designated generally as reference numeral 900. Customizable bat 900 may comprise a handle 910, a knob 920, and a marker 930. Knob 920 may be detachably affixed to handle 910 as previously described with reference to FIG. 3. Marker 930 may comprise a groove 940 with knob 920 containing a corresponding groove 950. The resulting opening between grooves 940 and 950 may permit a player to use a fingernail or thin object to pry up the marker 930 to allow removal of marker 930 without removing the knob 920 and/or pin.

Figure 10:
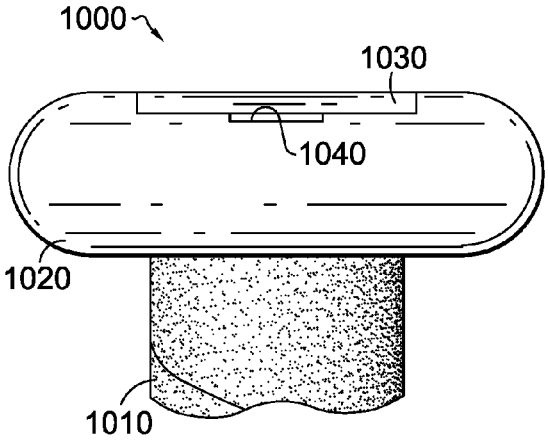
FIG. 10 depicts a perspective view of a portion of a customizable bat embodying features of the present invention.

Turning now to FIG. 10, another perspective view of a portion of a customizable bat illustrating features of the present invention is shown and designated generally as reference numeral 1000. Customizable bat 1000 may comprise a handle 1010, a knob 1020, and a marker 1030. Knob 1020 may be detachably affixed to handle 1010 as previously described with reference to FIG. 3. Knob 1020 may comprise a groove 1040 that permits a player to use a fingernail or thin object to pry up the marker 1030 to allow removal of marker 1030 without removing the knob 1020 and/or pin. Marker 1030 may be constructed of plastic or other material sufficiently flexible to permit the removal of marker 1030 from knob 1020 by prying the marker up from the knob.

Figure 11:
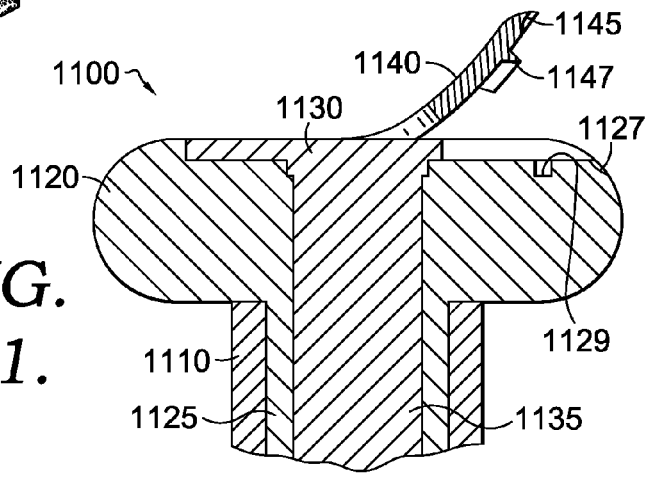
FIG. 11 depicts a cross sectional view of a portion of a customizable bat embodying features of the present invention.

Turning now to FIG. 11, a cross sectional view of a portion of a customizable bat illustrating features of the present invention is shown and designated generally as reference numeral 1100. Customizable bat 1100 may include a handle 1110, a knob 1120, a pin 1130 and a customizable marker 1140. Knob 1120 may be detachably affixed to handle 1110 by inserting a knob-shaft 1125 into handle 1110. In addition a shaft portion 1135 of pin 1130 may securely fasten in a central opening extending through the knob-shaft 1125. Customizable marker 1140 may be integrated in the top of knob 1120 such that the top of marker 1140 is substantially flush with the top of the knob 1120 upon insertion of the marker 1140 into the knob 1120. Marker 1140 may comprise a groove 1145 with knob 1120 containing a corresponding groove 1127. The resulting opening between grooves 1145 and 1127 may permit a player to use a fingernail or thin object to pry up the marker 1140, as shown in FIG. 11, to allow removal of marker 1140 without removing the knob 1120 and/or pin 1130. Marker 1140 may also comprise ridge 1147. Ridge 1147 may be located on the base of marker 1140 such that the ridge 1147 pops in a corresponding receiving slot 1129 located on the knob 1120 of the bat. Marker 1140 may be constructed of plastic or other material sufficiently flexible to permit the removal of marker 1140 from knob 1120 by prying the marker up from the knob. As shown in FIG. 11, marker 1140 may be pried up from knob 1120 such that the ridge 1147 on the marker clears the receiving slot 1129 in the knob 1120.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Embodiments of the present invention provide a customizable bat. The customizable bat in accordance with the present invention may have barrel and a handle having an end distanced from the barrel of the bat. A first channel may extend within a center of the handle and the barrel. The customizable bat may also include a knob having a knob-shaft configured for insertion into the first channel of the end of the handle. The knob may have a second channel extending centrally from a top of the knob through the knob-shaft toward the handle. A pin may be detachably affixed into the second channel to detachably affix the knob to the end of the handle. The bat may also include a marker that may indicate information associated with the bat. The customizable marker may be removably integrated with the top of the knob and the pin, the customizable marker may be configured to securely fit against the pin of the bat.

What is claimed is:

1. A customizable bat comprising:

a barrel;

a handle having an end distanced from the barrel of the bat;

a first channel extending within a center of the handle and the barrel;

a knob having a knob-shaft configured for insertion into the first channel of the end of the handle, the knob having a second channel extending centrally from a top of the knob through the knob-shaft toward the handle a pin detachably affixed into the second channel to detachably affix the knob to the end of the handle; and a customizable marker removably integrated with the top of the knob and the pin, the customizable marker configured to securely fit against the pin and comprising a U-shaped inner face that curves to fit around the pin.

2. The customizable bat of claim 1, wherein the handle comprises a plurality of internal holes radially distributed in the end of the handle distanced from the barrel.

3. The customizable bat of claim 2, wherein the knob-shaft comprises a plurality of prongs extending radially from the knob-shaft that engage the plurality of internal holes of the handle to retain the knob therein.

4. The customizable bat of claim 3, wherein the pin pushes the plurality of prongs of the knob shaft into the plurality of internal holes of the handle to lock the prongs of the knob into the handle.

5. The customizable bat of claim 1, wherein the knob is detachably affixed to the end of the handle by screwing the knob-shaft into the end of the handle distanced from the barrel.

6. The customizable bat of claim 1, further comprising the U-shaped inner face of the customizable marker having a pair of flanges extending from either side of the inner face of the marker, wherein the pair of flanges lock into a pair of undercuts on the pin.

7. The customizable bat of claim 6, wherein the customizable marker comprises a plurality of friction ridges, the friction ridges permitting insertion and removal of the customizable marker by engaging with a player's finger.

8. The customizable bat of claim 7, wherein the knob comprises a recessed area configured to receive the marker, the recessed area having external dimensions corresponding to external dimensions of the customizable marker such that the customizable marker is substantially flush with the top of the knob upon insertion of the marker into the knob.

9. The customizable bat of claim 8, wherein a base of the customizable marker comprises at least one ridge such that the at least one ridge securely fits into a receiving slot of the recessed area of the knob.

10. The customizable bat of claim 9, wherein the pin is shaped to engage with the customizable marker.

11. The customizable bat of claim 10, wherein the customizable marker is constructed of a plastic, metal or composite material.

12. The customizable bat of claim 11, wherein the pin is constructed of a metal or plastic material.

13. The customizable bat of claim 12, further comprising a gripping sleeve affixed to the handle.

14. The customizable bat of claim 13, wherein information associated with the bat comprises information about at least one of, a weight of the bat, a length of the bat, flexibility and a circumference of the bat.

15. The customizable bat of claim 14, wherein the customizable marker comprises a first groove between at least part of the marker and the knob, the first groove permitting prying up the marker to allow removal of the marker without removing the knob.

16. The customizable bat of claim 15, wherein the knob comprises a second groove between at least part of the marker and the knob, the second groove permitting prying up the marker to allow removal of the marker without removing the knob.

* * * * *